US010745623B2

(12) United States Patent
Faghihnejad et al.

(10) Patent No.: US 10,745,623 B2
(45) Date of Patent: Aug. 18, 2020

(54) METHODS FOR ENHANCING HYDROCARBON RECOVERY FROM OIL SANDS

(71) Applicant: Ecolab USA Inc., St. Paul, MN (US)

(72) Inventors: Ali Faghihnejad, Edmonton (CA); Song Gao, Sherwood Park (CA); Meng Luo, Edmonton (CA)

(73) Assignee: Ecolab USA Inc., St. Paul, MN (US)

( * ) Notice: Subject to any disclaimer, the term of this patent is extended or adjusted under 35 U.S.C. 154(b) by 0 days.

(21) Appl. No.: 15/418,170

(22) Filed: Jan. 27, 2017

(65) Prior Publication Data

US 2017/0218277 A1 Aug. 3, 2017

Related U.S. Application Data

(60) Provisional application No. 62/288,523, filed on Jan. 29, 2016.

(51) Int. Cl.
*C10G 1/04* (2006.01)

(52) U.S. Cl.
CPC ..... *C10G 1/045* (2013.01); *C10G 1/047* (2013.01)

(58) Field of Classification Search
CPC ..... C10G 1/04; C10G 1/045; C10G 1/047
See application file for complete search history.

(56) References Cited

U.S. PATENT DOCUMENTS 3,330,757 A 7/1967 Bichard
4,120,777 A 10/1978 Globus
4,409,091 A 10/1983 Kessick
4,694,906 A 9/1987 Hutchins et al.
4,929,341 A 5/1990 Thirumalachar et al.
4,946,597 A 8/1990 Sury
4,966,685 A 10/1990 Hall et al.
4,968,412 A 11/1990 Guymon
5,169,518 A 12/1992 Klimpel et al.
5,316,664 A 5/1994 Gregoli et al.
5,876,592 A 3/1999 Tipman et al.
5,985,138 A 11/1999 Humphreys
6,007,708 A 12/1999 Allcock et al.
6,251,290 B1 6/2001 Conaway
7,628,909 B2 12/2009 Cobb
7,931,800 B2 4/2011 Ozum
(Continued)

FOREIGN PATENT DOCUMENTS

CA 1000632 11/1976
CA 1022098 12/1977
(Continued)

OTHER PUBLICATIONS

Li, H. et al., Role of Acidified Sodium Silicate in Low Temperature Bitumen Extraction from Poor-Processing Oil Sand Ores, Ind. Eng. Chem. Res. 2005, 44, pp. 4753-4761.
(Continued)

*Primary Examiner* — Michelle Stein
(74) *Attorney, Agent, or Firm* — Stinson LLP

(57) ABSTRACT

The present invention generally relates to methods and process agents for bitumen extraction from ore. More specifically, the method comprises contacting a process agent to the ore and adding water to form a bitumen-containing slurry. The process agent comprises sodium silicate, an aluminate, a dodecyl sulfate, or a combination thereof.

20 Claims, 9 Drawing Sheets

(56) References Cited

U.S. PATENT DOCUMENTS

| | | | | |
|---|---|---|---|---|
| 2002/0104799 | A1 | 8/2002 | Humphreys | |
| 2005/0194292 | A1* | 9/2005 | Beetge | C10G 1/047 208/391 |
| 2008/0105622 | A1 | 5/2008 | Moran et al. | |
| 2008/0121566 | A1 | 5/2008 | Page et al. | |
| 2008/0223757 | A1 | 9/2008 | Ozum | |
| 2009/0090658 | A1 | 4/2009 | Burkus et al. | |
| 2010/0104744 | A1* | 4/2010 | Moffett | C04B 28/24 427/138 |
| 2012/0255887 | A1* | 10/2012 | Holms | C10G 1/047 208/390 |
| 2012/0289440 | A1 | 11/2012 | Pollard et al. | |
| 2015/0031594 | A1 | 1/2015 | Wakhloo | |

FOREIGN PATENT DOCUMENTS

| | | | |
|---|---|---|---|
| CA | 1023677 | | 1/1978 |
| CA | 1236419 | | 5/1988 |
| CA | 1237689 | | 6/1988 |
| CA | 2101240 | | 7/1992 |
| CA | 2421474 | A1 | 9/2003 |
| CA | 2428544 | A1 | 4/2004 |
| CA | 2629039 | A1 | 12/2005 |
| CA | 2568955 | A1 | 11/2006 |
| WO | 2006/025912 | A2 | 3/2006 |

OTHER PUBLICATIONS

International Search Report relating to PCT Patent Application No. PCT/US2017/015360 dated May 10, 2017, 6 pages.

Written Opinion relating to PCT Patent Application No. PCT/US2017/015360 dated May 10, 2017, 6 pages.

* cited by examiner

METHODS FOR ENHANCING HYDROCARBON RECOVERY FROM OIL SANDS

CROSS-REFERENCE TO RELATED APPLICATION

This application claims priority to U.S. Provisional Patent Application Ser. No. 62/288,523 filed on Jan. 29, 2016, the disclosure of which is incorporated herein by reference in its entirety.

FIELD OF THE INVENTION

The present invention generally relates to methods for extracting bitumen from ore, the method comprises contacting a process agent to the ore and adding water to form a bitumen slurry. The process agent comprises sodium silicate having a $SiO_2$ to $Na_2O$ ratio of from about 1.1 to about 10, an aluminate, a dodecyl sulfate, or a combination thereof.

BACKGROUND OF THE INVENTION

The largest oil sands deposit can be found in northern Alberta, Canada within the Athabasca region. Oil sands are comprised of a mixture of bitumen, solids, and water. The bitumen component of the oil sands consists of a heavy, viscous crude oil having a relatively high sulfur content. The various components can be extracted or separated and refined to generate numerous downstream commercial products. Specifically, bitumen can be separated from the oil sands to produce synthetic crude oil capable of being processed into various products.

The oil sands can be mined by truck and shovel and transported to an extraction facility. Bitumen can be removed from the oil sands by an extraction process of mixing the oil sand with hot water to form an ore-water slurry. Chemicals can optionally be added to the ore-water slurry to enhance the bitumen recovery. A well known extraction enhancement technique is to increase the pH of the slurry to increase the water-solubility of the bitumen. However, increasing the pH can also ionize organic acids and produce natural surfactants, extract the natural surfactants from the bitumen, and scavenge divalent cations, e.g., calcium and magnesium, thereby forming the metal carbonates Traditionally, additives such as caustic soda (NaOH) and/or soda ash ($Na_2CO_3$) are added to the ore-slurry mixture to increase the pH and the water-soluble fraction of bitumen. The surfactant formation can cause emulsification during froth treatment and hinder the settling of the tailings.

During forth treatment, emulsification of released bitumen in water and suspension of fine particles in the aqueous phase can occur. Emulsification can greatly reduce the overall bitumen extraction efficiency and cause environmental problems when the process water is being disposed. Additionally, an increased tailings settling time can lead to a reduction in land reclamation and water recirculation.

Therefore, a need exits to develop a process agent that can enhance bitumen recovery and froth quality while maintaining a short settling time and high water clarity.

SUMMARY OF THE INVENTION

One aspect of the invention is directed to a method for extracting bitumen from ore, the method comprising contacting a process agent to the ore and adding water to form a bitumen-containing slurry. The process agent comprises sodium silicate having a $SiO_2$ to $Na_2O$ ratio of from about 1.1 to about 10, an aluminate, a dodecyl sulfate, or a combination thereof.

Other objects and features will be in part apparent and in part pointed out hereinafter.

BRIEF DESCRIPTION OF THE DRAWINGS

Corresponding reference characters indicate corresponding parts throughout the drawings.

DESCRIPTION OF THE PREFERRED EMBODIMENTS

Figure 1:
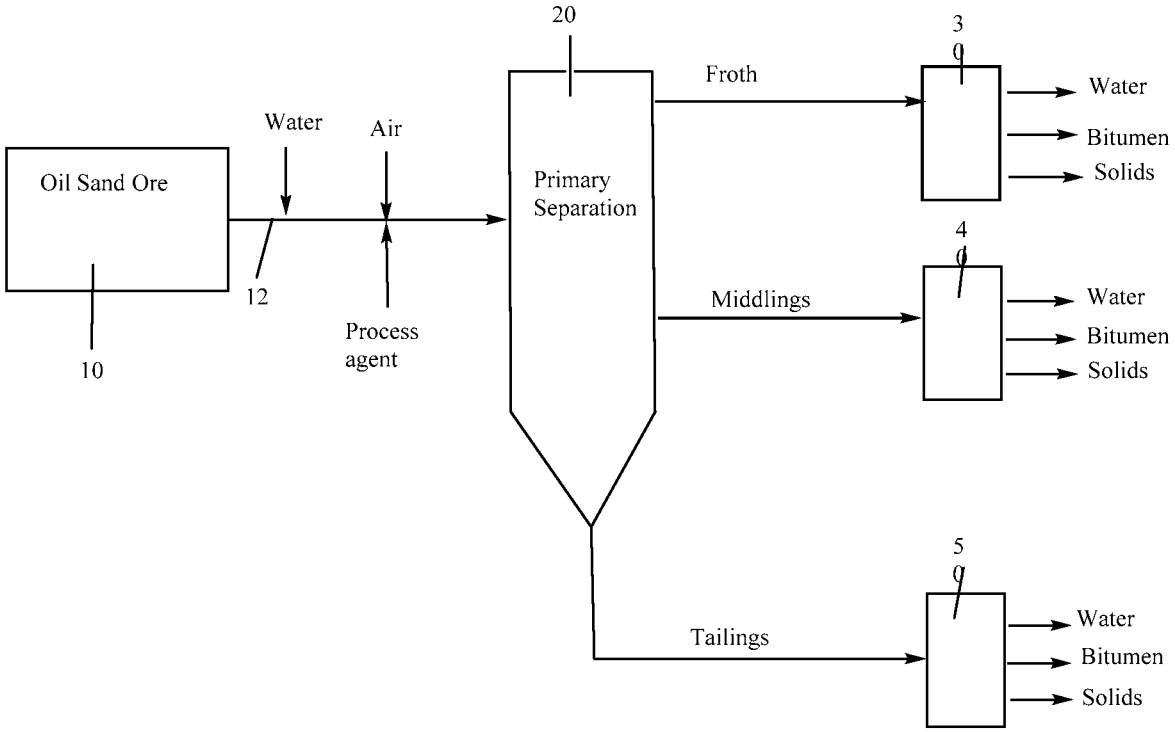
FIG. 1 is a schematic of a general process for bitumen recovery from oil sand.

The present invention is a method for recovering hydrocarbons, particularly a method for extracting bitumen from oil sands. The method comprises contacting an oil sands ore with a process agent, and separating the oil sands ore into a bitumen-containing froth portion and a tailings portion. The process agent used herein provides increased bitumen recovery, improved froth quality, and a relatively low tailings pH as compared to a process not including the process agent or as compared to caustic (e.g., caustic increases the tailings pH to a higher value than the process agent of the invention.) Preferably, the bitumen-containing source is separated in the presence of water and a process agent. The bitumen-containing source is contacted with the process agent before, during and/or after the primary separation, but the contact most preferably occurs before the primary separation in order to increase bitumen recovery. The contact can occur before or during transport of the bitumen-containing slurry (e.g., an oil sand slurry) to an extraction plant. Providing the process agent early in the process stream allows for better mixing and longer contact time with the bitumen, resulting in greater bitumen recovery effectiveness for the process agent.

In particular, the invention is directed to a method for extracting bitumen from an oil sand ore, the method comprising contacting a process agent to the oil sand ore and adding water to form a bitumen-containing slurry, the process agent comprising an aluminate, a dodecyl sulfate, sodium silicate having a $SiO_2$ to $Na_2O$ ratio of from about 1.1 to about 10, or a combination thereof.

The process agent can comprise sodium aluminate, aluminum sulfate, or a combination thereof.

The process agent can comprise sodium dodecyl sulfate, aluminum sulfate, or a combination thereof.

The process agent can also comprise ethylenediaminetetraacetic acid (EDTA), nitrilotriacetic acid (NTA), diethylenetriaminepenta(methylenephosphonic acid) (DTPPH), nitrilotris(methylenephosphonic acid) (NTMP), 1-hydroxyethane-1,1-diphosphonic acid (HEDP), or a combination thereof. Preferably, the process agent comprises EDTA.

The process agent can comprise sodium silicate having a $SiO_2$ to $Na_2O$ ratio of from about 1.5 to about 10, from about 2 to about 10, from about 3 to about 10, from about 1.5 to about 8, from about 2 to about 8, from about 2.5 to about 8, or from about 3 to about 8, from about 1.5 to about 6, from about 2 to about 6, from about 2.5 to about 6, or from about 3 to about 6.

The process agent can comprise sodium aluminate.

The process agent can comprise sodium dodecyl sulfate.

The process agent can comprise sodium aluminate and sodium silicate having a $SiO_2$ to $Na_2O$ ratio of from about 3 to about 6.

The process agent can comprise sodium dodecyl sulfate and sodium silicate having a $SiO_2$ to $Na_2O$ ratio of from about 3 to about 6.

The process agent can comprise sodium aluminate and sodium dodecyl sulfate.

The process agent can comprise sodium aluminate, sodium dodecyl sulfate, and sodium silicate having a $SiO_2$ to $Na_2O$ ratio of from about 3 to about 6.

The process agent can comprise sodium aluminate, sodium dodecyl sulfate, sodium silicate, and one of ethylenediaminetetraacetic acid (EDTA), nitrilotriacetic acid (NTA), diethylenetriaminepenta(methylenephosphonic acid) (DTPPH), nitrilotris(methylenephosphonic acid) (NTMP), or 1-hydroxyethane-1,1-diphosphonic acid (HEDP).

The process agent can comprise sodium dodecyl sulfate, sodium silicate, and one of ethylenediaminetetraacetic acid (EDTA), nitrilotriacetic acid (NTA), diethylenetriaminepenta(methylenephosphonic acid) (DTPPH), nitrilotris(methylenephosphonic acid) (NTMP), or 1-hydroxyethane-1,1-diphosphonic acid (HEDP).

The process agent can comprise sodium silicate, and one of ethylenediaminetetraacetic acid (EDTA), nitrilotriacetic acid (NTA), diethylenetriaminepenta(methylenephosphonic acid) (DTPPH), nitrilotris(methylenephosphonic acid) (NTMP), or 1-hydroxyethane-1,1-diphosphonic acid (HEDP).

The process agent can comprise sodium aluminate, sodium dodecyl sulfate, sodium silicate, and ethylenediaminetetraacetic acid (EDTA).

The process agent can comprise sodium dodecyl sulfate, sodium silicate, and ethylenediaminetetraacetic acid (EDTA).

The process agent can comprise sodium silicate, and ethylenediaminetetraacetic acid (EDTA).

The process agent can comprise from about 1 wt. % to about 80 wt. % EDTA and from about 20 wt. % to about 99 wt. % sodium silicate; from about 1 wt. % to about 75 wt. % EDTA and from about 25 wt. % to about 99 wt. % sodium silicate; from about 1 wt. % to about 60 wt. % EDTA and from about 40 wt. % to about 99 wt. % sodium silicate; from about 1 wt. % to about 50 wt. % EDTA and from about 50 wt. % to about 99 wt. % sodium silicate; from about 1 wt. % to about 40 wt. % EDTA and from about 60 wt. % to about 99 wt. % sodium silicate; from about 1 wt. % to about 20 wt. % EDTA and from about 80 wt. % to about 99 wt. % sodium silicate; from about 1 wt. % to about 10 wt. % EDTA and from about 90 wt. % to about 99 wt. % sodium silicate; from about 1 wt. % to about 5 wt. % EDTA and from about 95 wt. % to about 99 wt. % sodium silicate; or from about 1 wt. % to about 3 wt. % EDTA and from about 97 wt. % to about 99 wt. % sodium silicate.

The sodium silicate in the above process agent can have a $SiO_2$ to $Na_2O$ ratio of from about 3 to about 6.

The process agent can be formulated with an aqueous liquid wherein the aqueous liquid comprises water.

The process agent can be contacted to the oil sands ore at a concentration of about 40 to about 600 ppm based on the total weight of the oil sands ore.

The process agent can be contacted to the oil sands ore at a concentration of about 50 to about 500 ppm based on the total weight of the oil sands ore.

The amount of bitumen extracted from the oil sands ore can be increased as compared to the amount of bitumen extracted from the oil sands ore when the process agent is not present.

The method can comprise contacting the bitumen-containing slurry with additional water to form a bitumen froth and coarse solid tailings.

The bitumen froth can have less mineral solids and water as compared to the froth when the process agent is not present.

The method can comprise contacting the bitumen froth with a light hydrocarbon to form a bitumen product and fine solid tailings.

The bitumen product has less mineral solids and water as compared to bitumen product when the process agent is not present.

The coarse solid tailings can have a pH below about 9; preferably, the coarse solid tailings can have a pH between about 7 and about 8.

The fine solid tailings can have a pH below about 9; preferably, the fine solid tailings can have a pH between about 7 and about 8.

FIG. 1 is a schematic process flow diagram of a simplified embodiment of a bitumen recovery process. Oil sand ores are removed from natural deposits and crushed. The crushed oil sand ore 10 is contacted with water to form a slurry that will typically be passed through a transport line 12 to a bitumen extraction plant. The process agent is also added to the slurry, preferably at the upstream end of the transport line. At the bitumen extraction facility, air is injected into the slurry in association with a primary separation 20 of the bitumen from the sand or other inorganic material, such as clay. During the primary separation 20, the components of the oil sand ore are separated into froth, middlings and tailings. The froth comprises bitumen attached to the surfaces of air bubbles, typically accompanied by small but undesirable amounts of water and solids. The tailings comprise inorganic material, such as sand and clay, along with water. However, the tailings can also include a significant amount of bitumen. The middlings typically comprises less bitumen, more water, and more solids than the froth, and more hydrocarbon, less water, and less solids than the tailings. The froth, middlings and tailings typically undergo further separation processes in vessels 30, 40, 50, respectively, in order to increase the overall bitumen recovery efficiency and to increase the quality or purity of each stream. For example, it is desirable to further process the bitumen without water or solids, reuse the water without high solids content and dispose of the inorganic materials without excessive amounts of water. These objectives are achieved while avoiding large capital investments, avoiding further processing steps, and maintaining or increasing processing capacity through the use of the process agents. Specifically, the process agents serve to increase bitumen separation from inorganic material leading to greater bitumen content and less solids in the froth. The process agents separate out into the tailings where the aids improve consolidation of the solids from the water. The improved quality of the froth and the tailings can result in higher process capacities or throughput for a given processing facility.

The process agents are particularly beneficial when they make contact with the bitumen slurry before or during the primary separation, although the process agents are also beneficial in any secondary separations and any further separations (tertiary, etc.) of the hydrocarbons from sand, clay and other inorganic materials when the hydrocarbons do not efficiently separate from the inorganic solids. However, it should be emphasized that the method can be used to avoid the loss of hydrocarbons in a tailings or waste stream and that using the process agent at appropriate injection points will improve the overall hydrocarbon recovery efficiency, as well as processability. The process agents can also be used to treat middlings, which can include both hydrocarbons and sand, although the volume of primary middlings can be reduced if the process agent is used before or during the primary separation. It should be recognized that the process agents described herein can be introduced to the oil sands in various manners. For example, the process agents can be injected directly into an aqueous oil sand stream, or mixed with other process agents, such as transfer agents. It is preferably to inject the process agent into the process at a point located before the air is introduced into the transport pipeline. Specifically, it is anticipated that the process agents can be beneficially used in contactors, transport lines, tumblers, primary separators and secondary separators. Other processing vessel types and processing stages can also benefit from the use of these process agents.

The addition of the process agent into the process can be achieved manually or automatically, using batch, intermittent or continuous processes, and other techniques known in the art. It is preferred to provide the process agent automatically using a process control scheme. For example, the process control can include determining an amount of bitumen in the tailings portion, and varying the amount the process agent added to the bitumen-containing source to control the amount of bitumen in the tailings portion. This process control can be accomplished with an analog or digital microcontroller or computer-based process control system having an input signal for the bitumen in the tailings and an output signal to a flow control valve providing the process agent into the process. The input signal can be from a detector that measures the fluorescence of the tailings as an indicator of bitumen content. Such a detector can provide continuous detection by placing the detector in fluorescent communication with the process stream, or provide periodic detection by sampling the process stream.

The concentration of process agents used can vary accordingly to the type and condition of the bitumen in the oil sands ore and the specific process agent(s) being used. However, a process agent is preferably added in an amount effective to improve bitumen recovery.

The terms "oil," "bitumen," and "hydrocarbons" are used interchangeably herein to identify the hydrocarbon content of the oil sand, oil shale, crude oil, or other petroleum source or residue. These terms encompass hydrocarbons based on carbon chains or rings and also containing hydrogen with or without oxygen, nitrogen, sulfur or other elements, regardless of the color, viscosity, or condition of the hydrocarbons. These carbon chains or rings specifically encompass functional groups selected from alkyl, aryl, alkenyl and combinations thereof.

The bitumen-containing source can be various types of materials. For example, the source can be oil sand, oil shale, petroleum residues, and combinations thereof. The bitumen-containing sources are typically mixtures of bitumen and inorganic materials, such as sand, clay or rock. The process of the invention can also be beneficial in enhancing the recovery of other hydrocarbons that require separation from a mixture with inorganic substrates or particulates. Furthermore, the terms "oil," "bitumen," and "hydrocarbons" are used interchangeably herein to broadly identify the hydrocarbon content of the oil sand, oil shale, or other petroleum source or residue. These terms encompass hydrocarbons based on carbon chains or rings and also containing hydrogen with or without oxygen, nitrogen, sulfur or other elements, regardless of the color, viscosity, or condition of the hydrocarbons. These carbon chains or rings specifically encompass functional groups selected from alkyl, aryl, alkenyl and combinations thereof.

Having described the invention in detail, it will be apparent that modifications and variations are possible without departing from the scope of the invention defined in the appended claims.

EXAMPLES

The following non-limiting examples are provided to further illustrate the present invention.

Example 1: Process Agents

Process agents used in the following examples include sodium-metasilicate (commercially available from Sigma-Aldrich, St. Louis, Mo. and identified hereinafter as composition A), 2.5:1 sodium-silicate (commercially available from Sigma-Aldrich and identified hereinafter as composition B), 3.1:1 sodium-silicate (commercially available from The Science Company, Lakewood, Colo. and identified hereinafter as composition C), sodium hydroxide (commercially available from Fisher Scientific, Waltham, Mass. and identified hereinafter as composition D), sodium dodecyl sulfate (commercially available from Sigma-Aldrich and identified hereinafter as composition E), Nalco 2 (commercially available from Nalco-Champion and identified hereinafter as composition F), and 98% composition C plus 2% EDTA (identified hereinafter as composition G). The process agents were diluted in water to the desired dose prior to testing.

TABLE 1

Process agent compositions

| Composition | % Active | $SiO_2/Na_2O$ | pH |
|---|---|---|---|
| A | 10 | 1 | 12.5 |
| B | 37 | 2.5 | 11.8 |
| C | 37 | 3.1 | 11.3 |
| D | 10 | — | 14.4 |
| E | 10 | — | 9.1 |
| F | 10 | — | 14.0 |
| G | | 3.1 | |

Example 2: Batch Extraction Methods

A batch extraction unit (BEU) was used to simulate the extraction process and evaluate the performance of various process agents as set forth in Example 1.

Batch extraction methods were performed utilizing a BEU comprising a SERVODYNE high torque variable speed mixer with controller, Model #50003-00 (Cole-Palmer, Vernon Hills, Ill.), circulating constant temperature water bath, beaker, heating jacket, and an air cylinder fitted a pressure regulator and a controller. The air cylinder is attached via tubing to the impeller shaft which supplies air to the impeller and sample it is mixing.

Oil sands samples were collected from a field test site and frozen. A frozen oil sand sample was allowed to thaw and reach room temperature. The circulating water bath was heated to 55° C. (or desired temperature) and allowed to flow through the heating jacket. An oil sands sample (~500 g) was then added to the beaker within the BEU. A process agent or combination of process agents were added to the oil sands sample at a desired dosage. A sample of tap or process water (~2000 mL) was heated to ~60° C. Then 150 mL of the heated tap or process water was transferred to the beaker within the BEU.

The motor and impeller assembly was then lowered into the mixture and turned on. The motor and impeller assembly was raised and lowered multiple times to break any clumps. Once all the clumps were broken up, the motor and impeller assembly was lowered and set into position, 20 mm from the bottom of the beaker. The air supply was turn on and set at 150 mL/minute. The mixture was stirred at 600 rpm. After 10 minutes, the air was turned off and the mixture was flooded with 900 mL of heated tap or process water. The mixture was stirred again for another 10 minutes at 600 rpm.

Following mixing, the primary froth was skimmed off and transferred into a pre-weighed bottle. The primary forth sample was submitted for Dean Stark Analysis. The remaining mixture was stirred for an additional 5 minutes at 800 rpm with air addition at 50 mL/minute. Following mixing, the secondary froth was skimmed off and transferred into a pre-weighted bottle. The second froth sample was also submitted for Dean Stark Analysis.

The remaining mixture was drained into a pre-weighed 2-L jar. The impeller, motor, and beaker were washed with a mixture of 85% toluene and 15% isopropyl alcohol.

The primary recovery percentage was calculated using the following equation:

((Wt. of bitumen in primary froth+Wt. of bitumen in toluene wash)/(Wt. of oil sand used*% bitumen in oil sand*0.01))*100

The secondary recovery percentage was calculated using the following equation:

((Wt. of bitumen in secondary froth*100)/Wt. of oil sand used*% Bitumen in oil sand*0.01))*100

The total bitumen recovery percentage was calculated using the following equation:

Primary Recovery+Secondary Recovery

The scavenging efficiency was calculated using the following equation:

(Secondary Recovery*100)/(100−Primary Recovery)

The total froth quality was calculated using the following equation:

(Wt. of bitumen in Primary Froth+Wt. of bitumen in Secondary Froth)*100/(Wt. of Primary Froth+Wt. of Secondary Froth)

Example 3: Bitumen Extraction Tests

Oil sands samples were obtained from a field test site in Alberta, Canada and analyzed for bitumen, solids and water content. The compositions of the oil sands samples are described in Table 2, below.

TABLE 2

Oil sands composition

| Ore | Bitumen (%) | Solids (%) | Water (%) | Average Bitumen (%) |
|---|---|---|---|---|
| A-MG | 8.1 | 88.7 | 3.2 | 8.4 |
| | 8.2 | 88.8 | 3.0 | |
| | 8.8 | 88.2 | 2.9 | |
| A-LG | 9.9 | 88.0 | 2.1 | 10.0 |
| | 9.8 | 88.2 | 2.0 | |
| | 10.2 | 88.1 | 1.6 | |
| S-LG | 11.8 | 84.9 | 3.3 | 11.9 |
| | 12.1 | 84.9 | 3.0 | |
| | 11.9 | 85.1 | 3.0 | |
| Su-MG | 11.2 | 86.7 | 1.3 | — |
| Su-LG | 7.2 | 89.5 | 3.2 | — |

Process agents and combinations as set forth in Example 1 were contacted to three different oil sands compositions and evaluated for bitumen recovery.

Table 3, below, lists the process agents used with A-MG ore and the batch extraction test results.

TABLE 3

Results from A-MG ore

| Composition | Dosage (ppm) | Bitumen in ore (%) | Primary Recovery (%) | Secondary Recovery (%) | Total Recovery (%) | Primary B/S | Secondary B/S |
|---|---|---|---|---|---|---|---|
| A + F + E | 200 + 50 + 50 | 8.4 | 72.5 | 5.5 | 78.0 | 3.87 | 1.12 |
| D | 500 | 8.4 | 70.1 | 5.1 | 75.2 | 3.55 | 1.22 |
| A | 250 | 8.4 | 68.5 | 9.5 | 78.0 | 4.79 | 1.10 |
| D | 250 | 8.4 | 63.8 | 12.2 | 76.0 | 5.25 | 1.46 |
| A | 500 | 8.4 | 59.0 | 6.6 | 65.6 | 4.93 | 1.13 |
| F | 100 | 8.4 | 53.1 | 18.7 | 71.8 | 4.11 | 1.20 |
| A + F + E | 250 + 25 + 25 | 8.4 | 52.5 | 8.7 | 61.2 | 4.49 | 1.13 |
| F | 500 | 8.4 | 47.8 | 11.1 | 58.9 | 4.02 | 0.98 |
| Blank | — | 8.4 | 38.8 | 17.4 | 56.2 | 5.18 | 1.09 |

Figure 2:
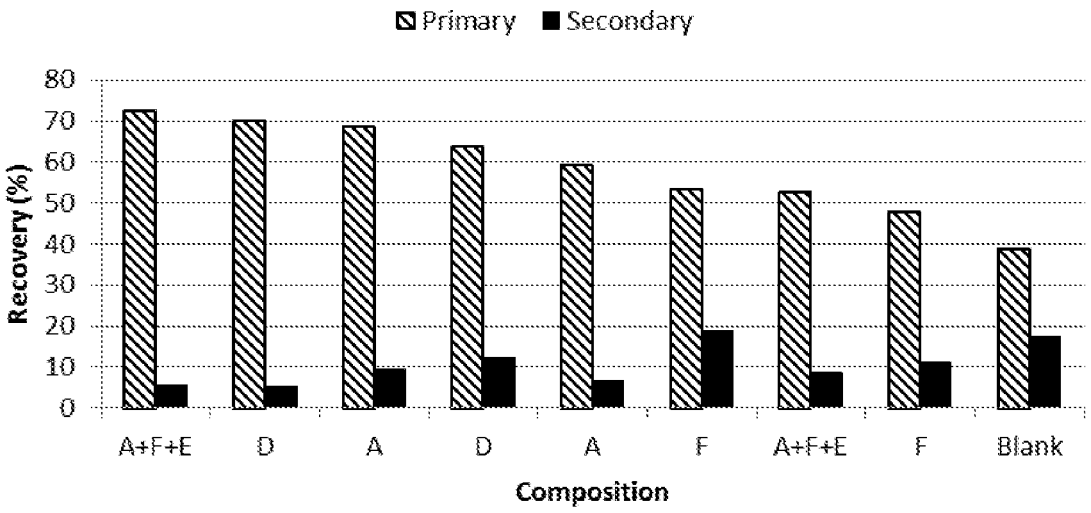
FIG. 2 is a graph of percent primary recovery of bitumen from A-MG ore treated with various process agents.
Figure 3:
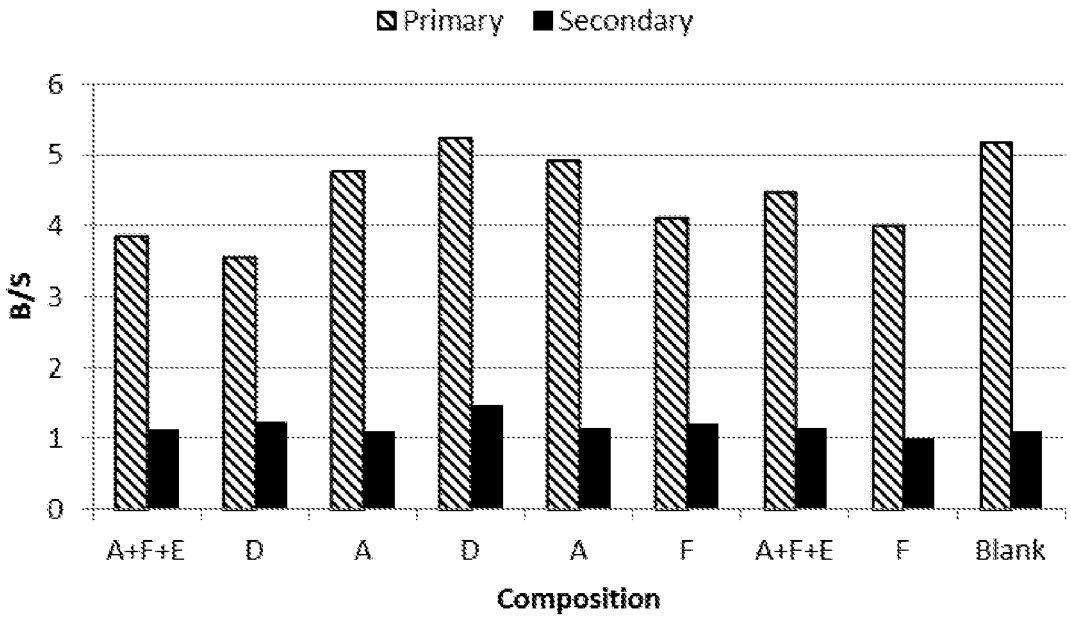
FIG. 3 is a graph of primary bitumen/solids (B/S) ratio from A-MG ore treated with various process agents.

Results are visually depicted in FIGS. 2 and 3. It can be seen from Table 3 that A+F+E increased the primary recovery as compared to composition D. Additionally, A+F+E and A had higher total recovery as compared to composition D.

Table 4, below, lists the process agents used with A-LG ore and the batch extraction test results.

TABLE 4

| Results from A-LG ore | | | | | | |
|---|---|---|---|---|---|---|
| Composition | Dosage (ppm) | Primary Recovery (%) | Secondary Recovery (%) | Total Recovery (%) | Primary B/S | Secondary B/S |
| A | 500 | 73.6 | 5.6 | 79.2 | 2.90 | 0.99 |
| D | 500 | 71.1 | 3.2 | 74.3 | 3.19 | 0.93 |
| D | 250 | 71.0 | 4.4 | 75.4 | 3.57 | 0.72 |
| C | 500 | 70.6 | 2.9 | 73.6 | 4.72 | 0.89 |
| B | 500 | 69.6 | 5.9 | 75.5 | 3.59 | 1.14 |
| B | 250 | 69.2 | 4.0 | 73.2 | 4.48 | 0.90 |
| C | 250 | 68.9 | 5.9 | 74.8 | 5.21 | 1.01 |
| A | 250 | 68.8 | 4.2 | 73.0 | 4.61 | 0.88 |
| Blank | — | 59.0 | 14.4 | 73.4 | 3.33 | 0.94 |

Figure 4:
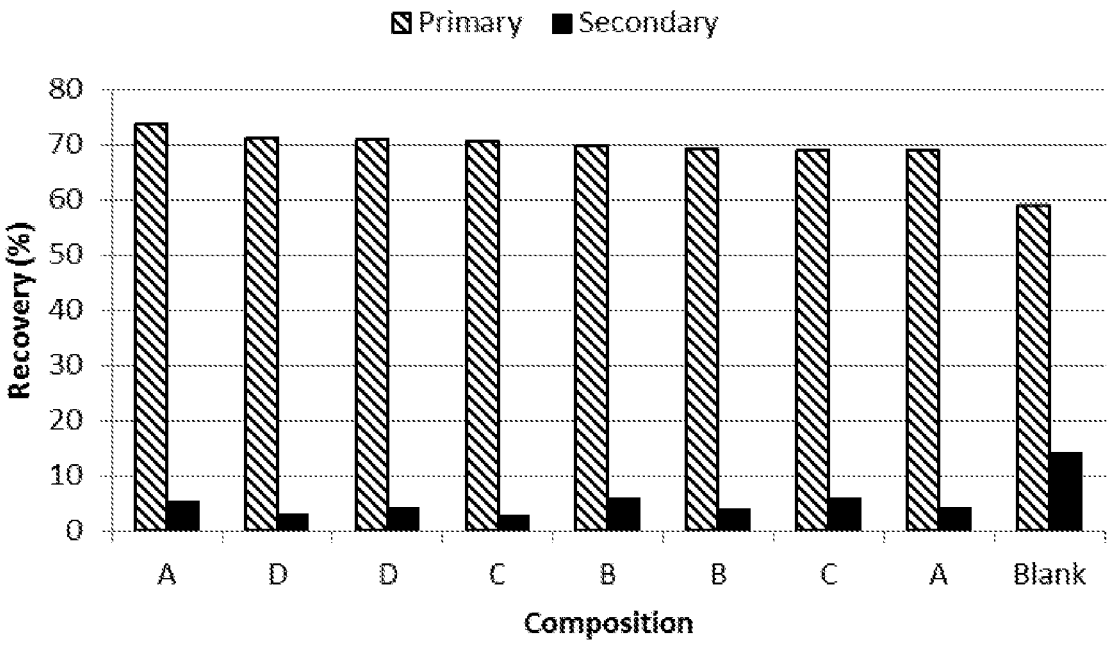
FIG. 4 is a graph of percent primary recovery of bitumen from A-LG ore treated with various process agents.
Figure 5:
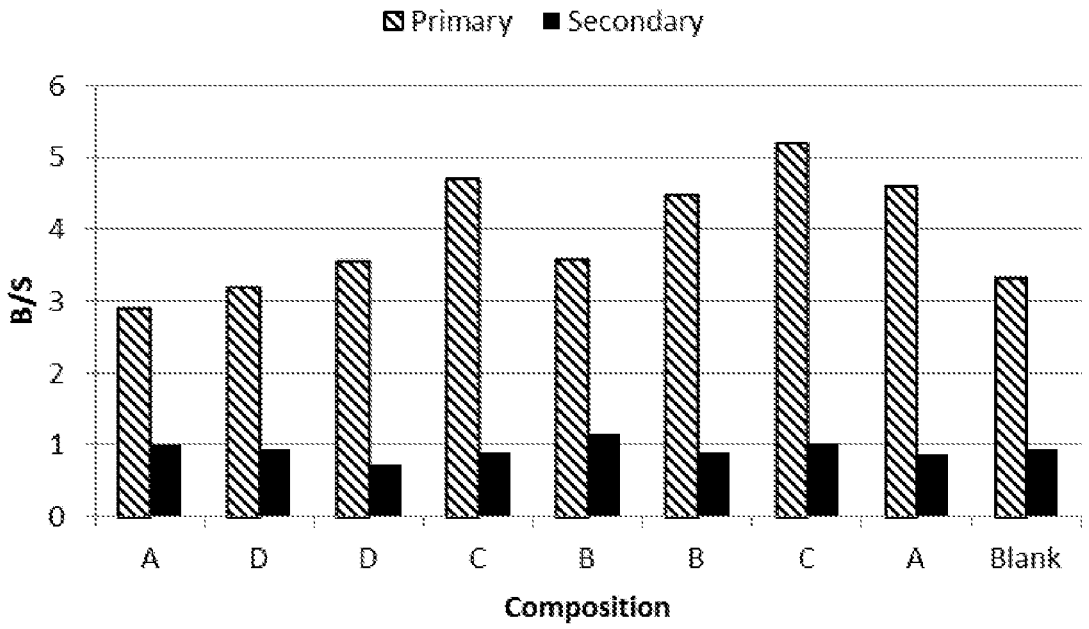
FIG. 5 is graph of primary bitumen/solids (B/S) ratio from A-LG ore treated with various process agents.

Results are visually depicted in FIGS. 4 and 5. It can be seen from Table 4 that composition A outperformed composition in primary, secondary, and total recovery.

Table 5, below, lists the process agents used with S-LG ore and the batch extraction test results.

TABLE 5

| Results from S-LG ore | | | | | | |
|---|---|---|---|---|---|---|
| Composition | Dosage (ppm) | Primary Recovery (%) | Secondary Recovery (%) | Total Recovery (%) | Primary B/S | Secondary B/S |
| C | 250 | 71.7 | 2.4 | 74.0 | 3.56 | 1.87 |
| C | 125 | 71.1 | 2.0 | 73.1 | 3.61 | 2.16 |
| B | 250 | 70.2 | 2.5 | 72.8 | 3.27 | 1.76 |
| B | 125 | 69.5 | 2.4 | 71.9 | 3.60 | 2.51 |
| A + E | 125 + 25 | 68.1 | 2.9 | 71.0 | 3.47 | 3.07 |
| D | 125 | 68.1 | 1.5 | 69.6 | 3.38 | 1.70 |
| A | 125 | 67.8 | 2.3 | 70.1 | 3.57 | 1.82 |
| A + E | 125 + 12.5 | 67.7 | 2.5 | 70.1 | 3.49 | 2.20 |
| A | 250 | 67.3 | 2.8 | 70.1 | 3.54 | 2.88 |
| D | 250 | 67.1 | 3.1 | 70.2 | 3.30 | 2.02 |
| D | 500 | 66.1 | 3.5 | 69.6 | 3.23 | 2.57 |
| A | 500 | 63.1 | 4.2 | 67.3 | 3.50 | 2.73 |
| Blank | — | 61.3 | 3.9 | 65.2 | 2.93 | 1.37 |

Figure 6:
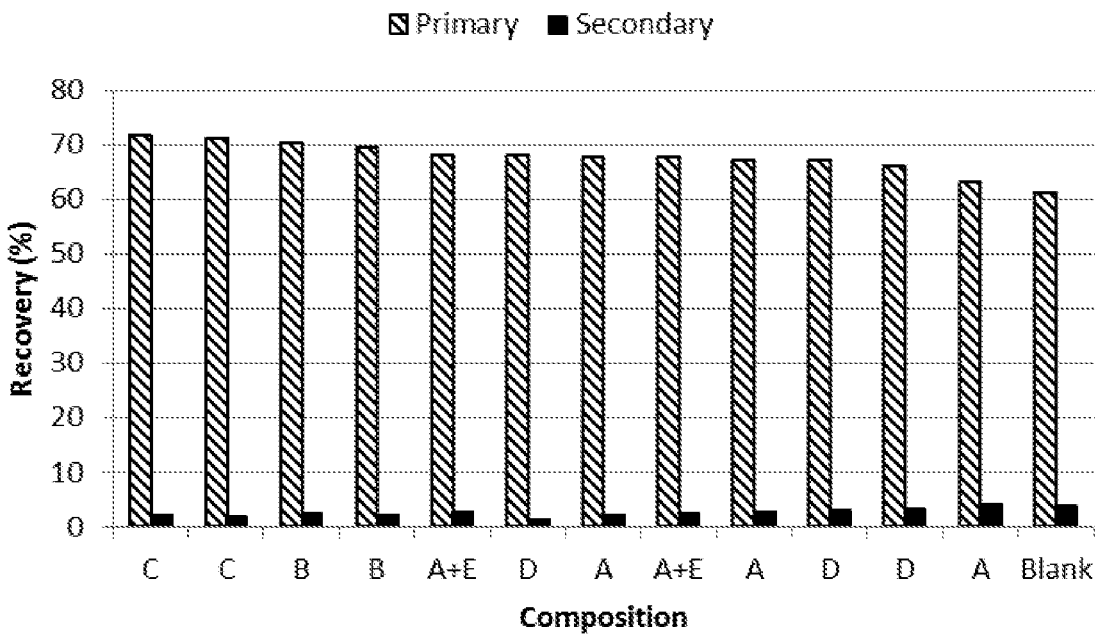
FIG. 6 is a graph of percent primary recovery of bitumen from S-LG ore treated with various process agents.
Figure 7:
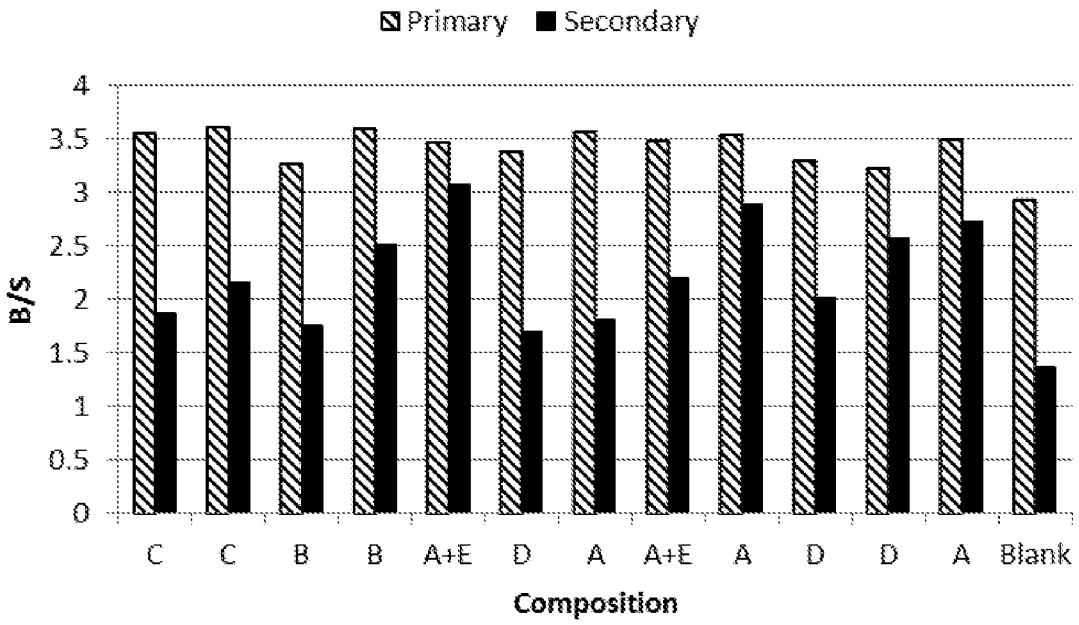
FIG. 7 is a graph of primary bitumen/solids (B/S) ratio from S-LG ore treated with various process agents.

Results are visually depicted in FIGS. 6 and 7. It can be seen from Table 5 that compositions B and C outperformed composition D at the same dosage. Additionally, compositions B, C, and A and E outperformed composition D in primary, secondary, and total recovery.

TABLE 6

| Analysis of tailings water from S-LG ore | | | | | | | | | |
|---|---|---|---|---|---|---|---|---|---|
| Composition | Dosage (ppm) | Calcium (Ca) | Magnesium (Mg) | Sodium (Na) | Chloride (Cl) | Sulfate ($SO_4$) | Hardness ($CaCO_3$) | Primary Recovery (%) | Primary B/S |
| Process water | — | 21.6 | 10.0 | 680 | 430 | 490 | 95 | — | — |
| D | 125 | 8.1 | 4.0 | 690 | 460 | 500 | 36 | 68.1 | 3.38 |
| D | 250 | 6.3 | 4.0 | 720 | 470 | 480 | 32 | 67.1 | 3.30 |
| D | 500 | 2.7 | 2.0 | 790 | 490 | 480 | 15 | 66.1 | 3.23 |
| A | 125 | 7.9 | 9.0 | 710 | 520 | 450 | 57 | 67.8 | 3.57 |
| A | 250 | 3.7 | 7.0 | 720 | 480 | 460 | 38 | 67.3 | 3.54 |
| A | 500 | 5.3 | 7.0 | 790 | 460 | 480 | 42 | 63.1 | 3.50 |
| B | 125 | 8.1 | 9.0 | 680 | 460 | 490 | 57 | 69.5 | 3.60 |
| B | 250 | 7.0 | 8.0 | 760 | 470 | 500 | 51 | 70.2 | 3.27 |
| C | 125 | 9.6 | 10.0 | 720 | 460 | 490 | 65 | 71.1 | 3.61 |
| C | 250 | 7.1 | 8.0 | 760 | 460 | 490 | 51 | 71.7 | 3.56 |

Figure 8:
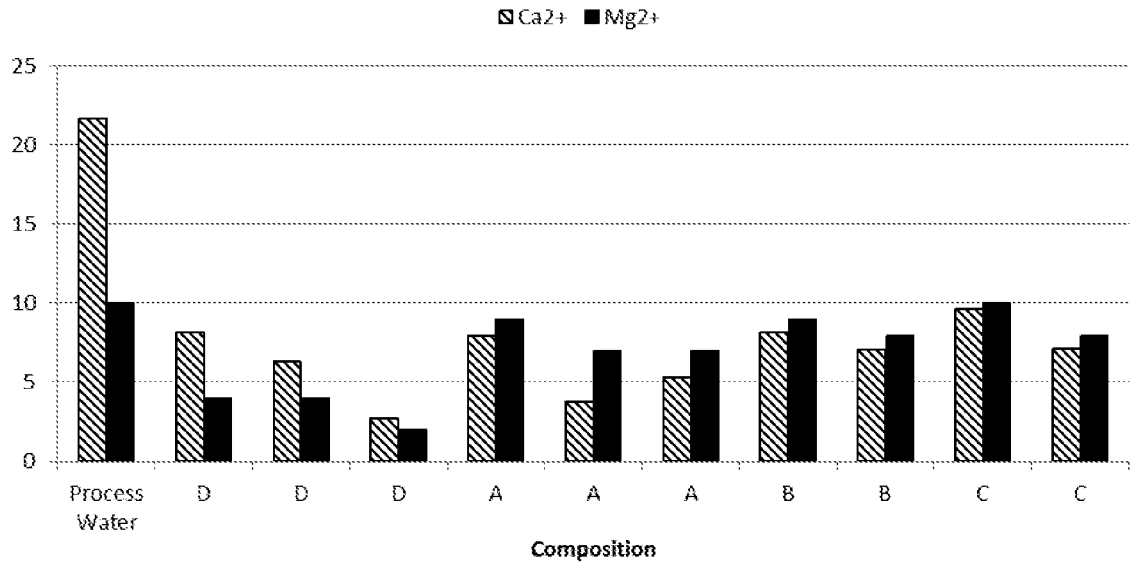
FIG. 8 is a graph of metal content in tailings water from S-LG ore treated with various process agents.
Figure 9:
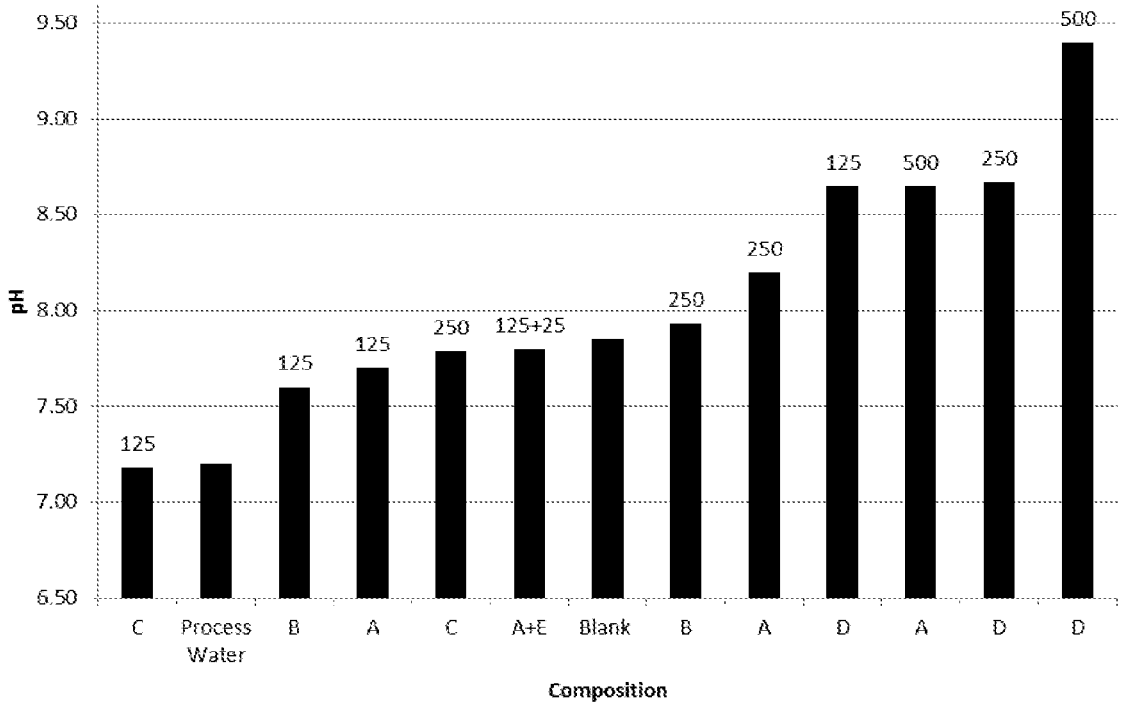
FIG. 9 is a graph of tailings pH from S-LG ore treated with various process agents.

Results are visually depicted in FIGS. 8 and 9.

Tables 7 and 8, below, lists the process agent compositions and comparator, NaOH, used with Su-LG and Su-MG ore and the batch extraction test results.

TABLE 7

| Results from Su-MG ore | | | | | | | | |
|---|---|---|---|---|---|---|---|---|
| Composition | dosage (ppm) | Primary Recovery (%) | Secondary Recovery (%) | Total Recovery (%) | PF bitumen (%) | PF solids (%) | PF water (%) | PF Total (%) |
| Blank | 0 | 95.7 | 2.8 | 98.5 | 69.4 | 12.0 | 17.9 | 99.3 |
| NaOH | 100 | 98.0 | 1.6 | 99.5 | 72.7 | 10.5 | 17.7 | 100.9 |
| NaOH | 250 | 91.4 | 2.0 | 93.5 | 72.2 | 11.3 | 18.1 | 101.6 |
| NaOH | 500 | 90.6 | 1.5 | 92.1 | 68.7 | 9.2 | 21.4 | 99.3 |
| G | 100 | 93.5 | 2.5 | 96.0 | 72.5 | 12.4 | 16.8 | 101.7 |
| G | 250 | 96.7 | 1.5 | 98.2 | 76.7 | 11.0 | 13.9 | 101.6 |
| G | 500 | 96.0 | 1.5 | 97.5 | 78.1 | 10.6 | 13.5 | 102.1 |

TABLE 8

| Results from Su-LG ore | | | | | | | | |
|---|---|---|---|---|---|---|---|---|
| Composition | dosage (ppm) | Primary Recovery (%) | Secondary Recovery (%) | Total Recovery (%) | PF bitumen (%) | PF solids (%) | PF water (%) | PF Total (%) |
| Blank | 0 | 64.5 | 22.4 | 87.0 | 48.8 | 6.3 | 44.3 | 99.3 |
| NaOH | 50 | 70.5 | 19.0 | 89.5 | 51.4 | 6.3 | 40.9 | 98.6 |
| NaOH | 100 | 81.7 | 14.1 | 95.7 | 54.4 | 7.1 | 38.3 | 99.9 |
| NaOH | 250 | 87.5 | 9.2 | 96.7 | 57.1 | 6.7 | 35.3 | 99.1 |
| NaOH | 500 | 94.6 | 2.8 | 97.4 | 69.5 | 8.5 | 20.7 | 98.7 |
| G | 50 | 84.8 | 11.6 | 96.4 | 56.4 | 7.7 | 35.5 | 99.6 |
| G | 100 | 89.7 | 7.2 | 96.9 | 60.5 | 7.8 | 32.0 | 100.3 |
| G | 250 | 85.4 | 10.3 | 95.7 | 56.8 | 7.6 | 35.7 | 100.1 |
| G | 500 | 90.7 | 5.5 | 96.2 | 63.8 | 7.1 | 29.6 | 100.6 |

Example 4: Froth Treatment Test

Equipment:—ARC metal Industries water bath, mechanical shaker, 250-mL glass jars with lids, Hamilton 50-μL syringe, Eppendorf syringe 10-100-μL& 100-1000-μL, top loading balance, analytical balance, Hamilton CR-700-50 syringe, Karl Fisher (Volumetric or Coulometric), 100-mL glass centrifuge tubes, 12.5-mL glass centrifuge tubes (graduation in %), SORVALL GLC-1 centrifuge, Damon/IEC Division Model K or ROTOFIX 46/46 Centrifuge, electric drill or drill press, glass funnel, and 10-mL syringe.

Reagents: wash and reagent grade toluene, simulated process water or process water, methanol, isopropanol, acetone, water standard(s), oil sand froth and naphtha, and demulsifier products.

The froth from the BEU test of Example 3 was homogenized thoroughly using the electrical drill or drill press. The composition of the froth was determined using the Dean-Stark extraction unit using the standard Dean-Stark procedure. About 100 g of the froth sample was transferred to a 250 mL glass jar and the froth jar and naptha were heated in a water bath to 80° C. An amount (20-30 grams) of naphtha was then added to the froth sample using a top loading balance. The sample jar was then wrapped to maintain heat and was put on a mechanical shaker on high setting for 5 minutes. The contents of the jar were transferred to a 150 mL separatory funnel and left to settle for 30 minutes.

Samples were collected at specified time intervals for dehydration and demineralization analysis. Dehydration was measured by assessing the water content of the oil phase using a Karl Fisher apparatus. Demineralization was measured by filling a 12.5-mL centrifuge tube to the 50% mark with a sample of the oil phase, adding toluene until the tube reads 100%, 2 drops of demulsifier (X-203) was added. The sample was shaken well, and then centrifuged for 10 minutes at 800 rpm. The volume % of free water and wet solids results were recorded and folded by two times to account for the toluene dilution.

After 20 to 30 minutes, the separatory funnel was removed from the water bath and the underflow was transferred into a 100-mL glass centrifuge tube and the mass of the underflow was recorded. The underflow was centrifuged for 10 minutes at 2000 rpm, and the volume of the oil phase, water, and wet solids were recorded.

Table 9, below, lists the process agent compositions and comparator, NaOH, used with Su-LG ore in the froth treatment test.

TABLE 9

| Results of froth treatment test in Su-LG ore | | | | |
|---|---|---|---|---|
| Composition | Dosage (ppm) | Top oil BSW (%) | Top oil solids (%) | Centrifuge composite oil KF (%) |
| Blank | 0 | 16.4 | 2.66 | 3.99 |
| NaOH | 50 | 13.0 | 1.86 | 4.15 |
| NaOH | 100 | 12.8 | 2.68 | 3.70 |
| G | 50 | 12.0 | 2.56 | 3.57 |
| G | 100 | 13.5 | 2.81 | 3.51 |

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there can be additional elements other than the listed elements.

In view of the above, it will be seen that the several objects of the invention are achieved and other advantageous results attained.

As various changes could be made in the above methods without departing from the scope of the invention, it is intended that all matter contained in the above description and shown in the accompanying drawings shall be interpreted as illustrative and not in a limiting sense.

What is claimed is:

1. A method for extracting bitumen from ore, the method comprising contacting a process agent to the ore before a primary separation and adding water to form a bitumen-containing slurry, the process agent consisting of sodium silicate having a $SiO_2$ to $Na_2O$ ratio of from about 2 to about 10, and at least one of ethylenediaminetetraacetic acid, nitrilotriacetic acid, diethylenetriamine penta(methylenephosphonic acid), nitrilotris(methylenephosphonic acid), 1-hydroxyethane-1,1-diphosphonic acid, or a combination thereof.

2. The method of claim 1, wherein the sodium silicate has a $SiO_2$ to $Na_2O$ ratio of from about 3 to about 6.

3. The method of claim 1, wherein the process agent consists of sodium silicate having a $SiO_2$ to $Na_2O$ ratio of from about 2 to about 10 and ethylenediaminetetraacetic acid.

4. The method of claim 3, wherein the process agent consists of from about 90 wt. % to about 99 wt. % sodium silicate and from about 1 wt. % to about 10 wt. % ethylenediaminetetraacetic acid.

5. A method for extracting bitumen from ore, the method comprising contacting a process agent to the ore before a primary separation and adding water to form a bitumen-containing slurry, the process agent consisting of sodium silicate having a $SiO_2$ to $Na_2O$ ratio of from about 2 to about 10, dodecyl sulfate, and at least one of ethylenediaminetetraacetic acid, nitrilotriacetic acid, diethylenetriamine penta (methylenephosphonic acid), nitrilotris(methylenephosphonic acid), 1-hydroxyethane-1,1-diphosphonic acid, or a combination thereof.

6. The method of claim 5, wherein the process agent consists of sodium silicate having a $SiO_2$ to $Na_2O$ ratio of from about 2 to about 10 and ethylenediaminetetraacetic acid.

7. The method of claim 6, wherein the sodium silicate has a $SiO_2$ to $Na_2O$ ratio of from about 3 to about 6.

8. The method of claim 5, wherein the process agent is contacted to the ore at a concentration of about 40 to about 600 ppm.

9. The method of claim 5, wherein the amount of bitumen extracted from the ore is increased as compared to the amount of bitumen extracted from the ore when the process agent is not present.

10. The method of claim 5, further comprising contacting the bitumen-containing slurry with additional water to form a bitumen froth and coarse solid tailings.

11. The method of claim 10, further comprising contacting the bitumen froth with a light hydrocarbon to form a bitumen product and fine solid tailings.

12. The method of claim 11, wherein the bitumen product has less mineral solids and water as compared to bitumen product when the process agent is not present.

13. The method claim 11, wherein the coarse solid tailings and the fine solid tailings have a pH below about 9.

14. The method of claim 3, wherein the process agent comprises from about 20 wt. % to about 99 wt. % sodium silicate and from about 1 wt. % to about 80 wt. % ethylenediaminetetraacetic acid.

15. The method of claim 1, wherein the amount of bitumen extracted from the ore is increased as compared to the amount of bitumen extracted from the ore when the process agent is not present.

16. The method of claim 1, further comprising contacting the bitumen-containing slurry with additional water to form a bitumen froth and coarse solid tailings.

17. The method of claim 16, further comprising contacting the bitumen froth with a light hydrocarbon to form a bitumen product and fine solid tailings.

18. The method of claim 17, wherein the bitumen product has less mineral solids and water as compared to bitumen product when the process agent is not present.

19. The method claim 17, wherein the coarse solid tailings and the fine solid tailings have a pH below about 9.

20. The method of claim 1, wherein the process agent is contacted to the ore at a concentration of about 40 to about 600 ppm.

* * * * *